US005875807A

United States Patent [19]

Schulze

[11] Patent Number: 5,875,807

[45] Date of Patent: Mar. 2, 1999

[54] FLOW CONTROL ESPECIALLY FOR INSTANTANEOUS WATER HEATER

[75] Inventor: Klaus Schulze, Gernrode, Germany

[73] Assignee: Mertik Maxitrol GmbH & Co., KG, Germany

[21] Appl. No.: 765,839

[22] PCT Filed: Jun. 8, 1995

[86] PCT No.: PCT/EP95/02208

§ 371 Date: Jan. 15, 1997

§ 102(e) Date: Jan. 15, 1997

[87] PCT Pub. No.: WO96/02795

PCT Pub. Date: Feb. 1, 1996

[30] Foreign Application Priority Data

Jul. 16, 1994 [DE] Germany ..... 44 25 200.5

[51] Int. Cl.[6] ..... F23N 1/00

[52] U.S. Cl. ..... 137/94; 251/214; 251/58

[58] Field of Search ..... 137/94; 251/214, 251/58

[56] References Cited

U.S. PATENT DOCUMENTS

| | | | |
|---|---|---|---|
| 2,126,378 | 8/1938 | Feidler et al. | 137/94 |
| 2,258,590 | 10/1941 | Merten | 137/94 |
| 3,327,761 | 6/1967 | Rowell | 137/94 |
| 4,200,258 | 4/1980 | Gliatas | 251/214 |
| 4,299,373 | 11/1981 | Troyer | 251/58 |
| 4,457,486 | 7/1984 | DeFrees | 251/58 |
| 4,655,239 | 4/1987 | Kato | 137/94 |

FOREIGN PATENT DOCUMENTS

| | | |
|---|---|---|
| 882482 | 6/1943 | France . |
| 1010002 | 6/1952 | France . |
| 647449 | 6/1937 | Germany . |
| 1065595 | 9/1959 | Germany . |
| 1908408 | 9/1970 | Germany . |
| 538650 | 8/1941 | United Kingdom . |
| WO 94/00716 | 1/1994 | WIPO . |

*Primary Examiner*—Henry Bennett
*Assistant Examiner*—Joanne Y. Kim
*Attorney, Agent, or Firm*—Harness, Dickey & Pierce, P.L.C.

[57] ABSTRACT

Fitting, especially for a continuous flow water heater.

The submitted invention takes as its basis the problem of developing a fitting of the named type by which the formation of calcareous deposits on the rod protruding from the water control housing is lessened and the influence of such calcareous deposits on the controller action is completely eliminated.

The problem is solved in that within water control housing (2), the control motion of membrane (24) is transmitted to a lever (3) whose center of rotation forms a shaft (4), rigidly connected to this lever (3) and whose pivot is sealed, leading to the exterior of water control housing (2). At the same time, shaft (4) is also the center of rotation for a second lever (5) which is likewise rigidly connected to it. Thus the stroke motion of the first lever (3) is transmitted to the exterior via shaft (4) as a rotary motion and subsequently the rotary motion of shaft (4) is re-converted, by means of second lever (5), into a stroke motion to control the gas outlet.

The fitting serves to control gas flow depending on water flow especially for continuous flow water heaters.

10 Claims, 3 Drawing Sheets

FLOW CONTROL ESPECIALLY FOR INSTANTANEOUS WATER HEATER

BACKGROUND AND SUMMARY OF THE INVENTION

The submitted invention concerns a fitting, especially as applied in a continuous flow water heater to control gas flow depending on water flow. Thereby the fitting has a gas control housing, a water control housing and a mechanical transmission which transmits a control motion, depending on the water flow and arising preferably from a Venturi tube and a membrane in the water control housing, extending initially from the interior of the water control housing, then outwards to a valve controlling the volume of gas within the gas control housing.

Fittings for continuous flow water heaters usually consist of gas and water components. In these fittings, gas control is activated by a hydraulic adjusting drive, which produces a particular stroke to control the volume of gas depending on the volume of water flowing through the fitting. Thereby the stroke starts mostly at particular minimal value, determined by the necessary volume of gas required to ignite the burner, and finishes at a particular maximum value which is determined by the technical layout of the gas burner and the heat exchanger.

As already discussed above and, for example, as shown in DR-PS 647 449, a control device, located in the water component, has a membrane through which the control housing is divided into chambers which are connected via pipes with parts of the fluid pipe which lies before and behind a pressure regulating valve. A gas pressure switch, located in the gas component, has a valve with a valve body which is moved by a further member. The membrane is controlled by pressure difference produced by a pressure regulating valve in a gas pipe leading to the burner. The control device is connected via a rod with a valve body belonging to the pressure regulating valve.

Another fitting for a continuous flow water heater is described in WO 94/00716. In this case, a control device, designated as a flow switch, is located in the water component and serves as a water deficiency safety device. This flow switch has a high pressure chamber and a low pressure chamber which are separated from each other by a membrane. The membrane is supported on a membrane plate rigidly connected with a rod which itself is sealed and leads out of the low pressure chamber. Thereby the membrane, membrane plate and rod form the adjusting drive for a gas volume control valve arranged in the gas component.

The construction of the fittings described in the above named patent documents have a problem in that the rod, serving to transmit the stroke, carries out an axial motion. Due to this axial motion, the rod transports water particles despite a seal being present. In order to prevent water particles getting into the gas control space, it is usually necessary that there be an air space between the water and gas control spaces. Additionally, the rod is made in two pieces. The problem still remains that by increasing rod stroke due to increasing water usage, a film of water on the rod is brought outside by the axial motion and assisted by the water pressure. This film of water evaporates in the air and leads to calcareous deposits on the rod. During the backstroke of the rod, due to decreasing water usage, this calcareous layer is drawn through the seal which damages the seal and thus leads to greater leakage. Furthermore, the control deviation of the continuous flow water heater is enlarged due to the increasing friction of the rod. Especially by the reduction of the volume of water flowing through, the volume of gas is no longer sufficiently reduced which leads to water temperatures being too high and the corresponding hazards to the user arise. The calcareous deposits can extend so far that the gas volume control valve remains open when the water supply is completely cut-off, which leads to destruction of the continuous flow water heater if special over-temperature protection device is not present.

By the employment of grease seals, double gaskets and ceramic guides, one can indeed delay these negative consequences but water transport, due the axial motion of the rod, remains thus leading to a breakdown at some time or other. Furthermore, such measures have the disadvantage that the constructional size and finally the costs are increased.

The invention takes as its basis the problem of developing a fitting of the above mentioned type by which the formation of calcareous deposits on the rod protruding from the water control housing is lessened and the influence of such calcareous deposits on the controller action, as described in detail above, is completely eliminated.

According to the invention, the problem is solved in that within the water control housing, the control motion of the membrane is transmitted to a lever whose centre of rotation forms a shaft, rigidly connected to this lever and whose pivot is sealed, leading to the exterior of the water control housing. At the same time, the shaft is also the centre of rotation for a second lever which is likewise rigidly connected to it. Thus the stroke motion of the first lever is transmitted to the exterior via the shaft as a rotary motion and subsequently the rotary motion of the shaft is again converted, by means of the second lever, into a stroke motion to control the gas outlet.

By converting the stroke motion of the membrane to a rotary motion, the situation is achieved whereby the sealing element required for sealing, usually an O-ring, always seals the shaft at the same position. An axial motion no longer occurs in the sealing area. Thus the previously occurring transport of water particles from the water control housing and the thereby associated negative consequences do not take place. Even if a leakage flux should occur, despite the seal found between the water control housing and the shaft, and calcareous deposits forms on the outer end of the shaft, this has no influence on bearing friction and controller action. As a further advantage, the influence of water pressure on the volume of gas flow, as described in the state-of-the-art, (the cause being due to the effective force components of water pressure on the cross-section of the rod) is not encountered with the solution, offered by the present invention.

Through the measures laid out in the sub-claims, advantageous further developments of the object of the main claim are possible.

Thus the fitting, according to the invention, is constructed such that the second lever outside the water control housing is connected to the shaft in one piece. The resulting stroke motion of the second lever is then transmitted by the known method via a rod in the gas control housing to a valve controlling the volume of gas. Thereby, a connecting rod element can be arranged additionally between the second lever and the rod, whereby at the same time an adjustment position is created.

A further advantageous form of construction of the invention consists in that the shaft, whose pivot is sealed, leads into the interior of the gas control housing, in which the second lever is arranged such that the transmission of the control motion is likewise no longer axial. It is more favourable if the shaft is made in two parts, whereby a first part of the shaft leads from the interior of the water control housing to its exterior whereas a second part of the shaft leads from the interior of the gas control housing to its exterior. Thereby it is made possible to create an adjustment position at the transition between the first and second parts of the shaft.

BRIEF DESCRIPTION OF THE DRAWINGS

A form of construction of the invention is shown in drawings and described in detail in the following. There is.

DESCRIPTION OF THE PREFERRED EMBODIMENT

Figure 1:
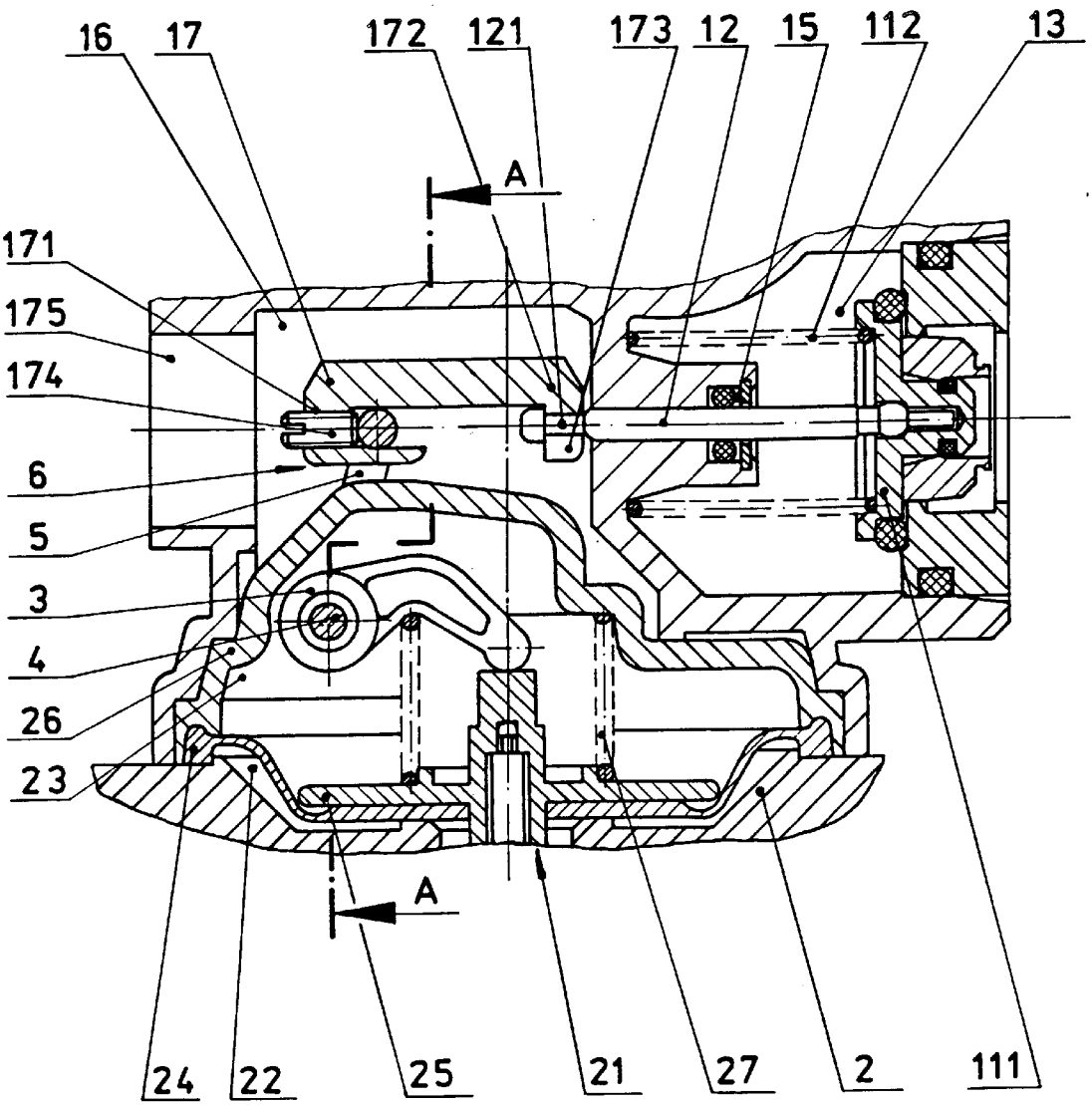
FIG. 1 is a partial sectional view of a fitting for a gas heated continuous flow water heater with closed gas volume control valve.
Figure 2:
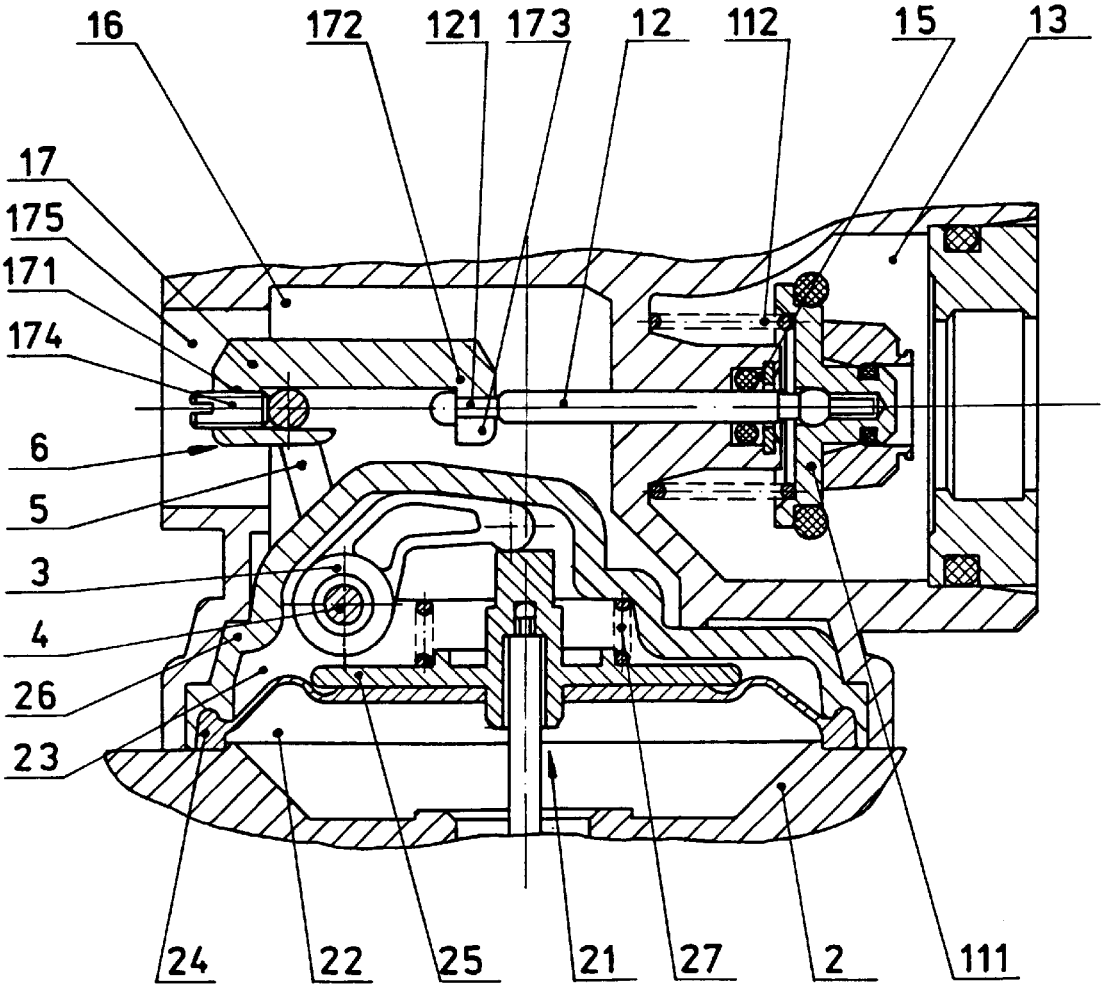
FIG. 2 is a partial sectional view of the fitting of FIG. 1 but showing the gas volume control valve in an open position.

The partly shown fitting in FIG. 1 for a gas heated continuous flow water heater with closed gas volume control valve (11) and the partly shown fitting in FIG. 2 for a gas heated continuous flow water heater with opened gas volume control valve (11) has a gas control housing (1) and a water control housing (2).

The water control housing (2) contains a flow switch (21) serving as water deficiency safety device in addition to other components which are known to the expert and, because they are not material to the invention, are not explained in detail. This flow switch (21) has a high pressure chamber (22) and a low pressure chamber (23) which are both separated from each other by a membrane (24). The membrane (24) is supported on a membrane plate (25). The low pressure chamber (23) is closed by a cover (26) which is connected on the one side with the water control housing (2) and, on the other side, is partly enclosed in a chamber by the gas control housing (1). A compression spring (27) is supported at one end in cover (26) and lies at its other end on membrane plate (25).

A cranked lever (3) is supported on one end of membrane plate (25) and is connected rigidly at its other end with shaft (4), which is sealed in and pivotably supported by cover (26). Thereby shaft (4) forms at the same time a centre of rotation for a second lever (5) whereby it is advantageous if shaft (4) and lever (5) are made in one piece in the form of a U-rod (6). (See FIG. 3)

The gas control housing (1) contains a gas volume control valve (11) in addition to other components which are known to the expert and, because they are not material to the invention, are not explained in detail. The gas volume control valve 11 is located in a cup-shaped (13) within whose base (14) an otherwise gas-tight guide (15) for a rod (12), axially moveable in the longitudinal direction, is located and which is connected with valve plate (111) of gas volume control valve (11). The valve plate (111) is loaded by a return spring (112) in the closure direction which is supported at its other end on base (14). Rod (12) has, at its end averted from gas volume control valve (11), an indent (121) serving as an attachment for a connecting rod element (17). This end protrudes into space (16) of the gas control housing (1).

In this form of construction, connecting rod element (17) is a U-shaped constructed part. There is a threaded bore (171), for example, in one shank of the connecting rod element 17 serving to accommodate an element, adjustable in the longitudinal direction, which may be a screw (174) for example. Additionally, one of the two shanks is lengthened and its end (172) offset. There is a recess (173), in the offset end (172) in the axial extension of bore 171, serving to accommodate the indent (121) of rod (12).

Lever (5) (part of U-shaped rod (6) in this form of construction) is supported in the fixture formed by both shanks and braced on screw (174) by the effective forces of return spring (112) and compression spring (27).

Figure 3:
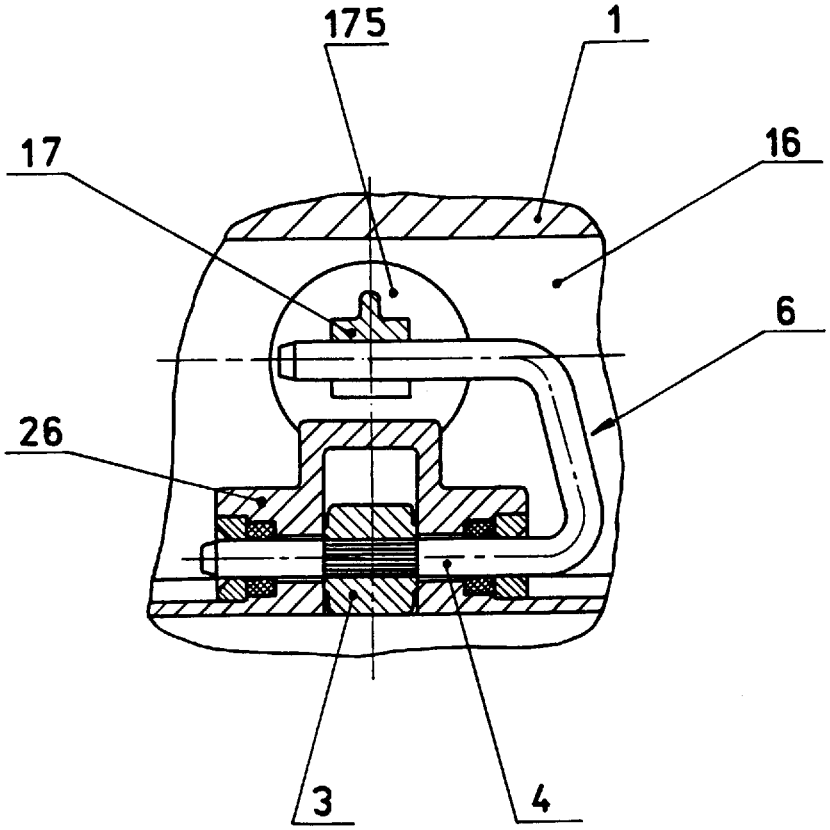
FIG. 3 is a sectional view of the fitting of FIG. 1, the section being taken along line A—A thereof.

The function of the fitting for a continuous flow water heater shown in FIGS. 1 to 3 is described as follows:

When water is taken, a differential pressure arises due to the suction effect of a Venturi tube (not shown) between high pressure chamber (22) and low pressure chamber (23) in water control housing (2), which results in a stroke motion of membrane (24). This stroke motion is transmitted to lever (3) via membrane plate (25). Due to the fixed connection between lever (3) and shaft (4), this stroke motion is converted to a rotary motion and at he same time is lead out of water control housing (2). The rotary motion of shaft (4) is transmitted further to lever (5) and thereby at the same time is re-converted into a stroke motion, because shaft (4) is also the centre of rotation for lever (5). By means of connecting rod element (17), this stroke motion acts against rod (12) whereby gas volume control valve (11), which was closed up to this time, is opened.

Depending on the volume of required water and degree of the set differential pressure, due to the different suction effect of the Venturi tube, gas volume control valve (11) is opened either more or less. Thus although FIG. 2 shows the maximum opening of gas volume control valve (11), it is self-evident that intermediate positions are possible.

In order to be able to undertake a correlation between the stroke of membrane (24) and the stroke of gas volume control valve (11) due to manufacturing tolerances, it is proved to be advantageous in providing an adjustment element. This task is accomplished in this form of construction through screw (174) whose screw-in depth can be varied as desired by aperture (175).

The fitting, according to the invention, is self-evidently not limited to the shown form of construction. On the contrary, changes and deviations are possible without leaving the framework of the invention. For example, shaft (4), sealed and pivoted, can be lead into the interior of gas control housing (1), whereby it is understood that in this case, lever (5) has to be arranged in the interior of gas control housing (1). Moreover, shaft (4) can be made in two parts, whereby a first part of shaft (4) leads from the interior of water control housing (2) to its exterior whereas a second part of shaft (4) leads form the interior of gas control housing (1) to its exterior. A desired adjustment possibility is then found more favourably between the duct from water control housing (2) and the duct from gas control housing (1).

I claim:

1. A fitting for controlling gas flow in a continuous flow water heater in response to water flow through said heater, said fitting comprising:

a gas control housing having a gas flow control valve disposed therein and being movable between open and closed positions;

a water control housing having a water flow member movably disposed therein, said water flow member being movable in response to the volume of water flow between a first position responsive to a minimum flow and a second position responsive to a maximum flow;

mechanical transmission means for transmitting movement of said water flow member to said gas flow control valve to effect movement thereof between said open and closed positions, said mechanical transmission means including a shaft rotatably sealingly supported in said water control housing, movement of said water flow member being operative to effect rotary movement of said shaft and rotary movement of said shaft being operative to effect controlled movement of said gas flow control valve between said open and closed positions.

2. A fitting for controlling a gas flow as set forth in claim 1 wherein said water flow member comprises a membrane.

3. A fitting for controlling gas flow as set forth in claim 2 wherein said shaft includes a first portion extending into the interior of said water control housing, a lever secured to said shaft, movement of said membrane being operative to effect rotary motion of said shaft via said lever.

4. A fitting for controlling gas flow as set forth in claim 3 wherein said shaft includes a second portion extending externally of said water control housing and coupling means for coupling said shaft to said gas flow control valve.

5. A fitting for controlling gas flow as set forth in claim 4 wherein said coupling means converts rotary motion of said shaft into reciprocating movement to effect movement of said gas flow control valve.

6. A fitting for controlling gas flow as set forth in claim 5 wherein said coupling means comprise a second lever.

7. A fitting for controlling as flow as set forth in claim 6 wherein said second lever is integrally formed with said shaft.

8. A fitting for controlling gas flow as set forth in claim 5 wherein said gas flow control valve includes a rod extending therefrom, said coupling means being connected to said rod.

9. A fitting for controlling gas flow as set forth in claim 5 wherein said coupling means include an adjustment member whereby the position of said gas flow control valve for a given position of said membrane may be adjusted.

10. A fitting for controlling gas flow as set forth in claim 5 wherein said gas control housing includes a partition separating said housing into a first chamber and a second chamber, said gas flow control valve being located in said first chamber and including a rod extending through said partition in movably sealed relationship therewith into said second chamber, said second portion of said shaft and said coupling means being disposed in said second chamber.

* * * * *

UNITED STATES PATENT AND TRADEMARK OFFICE

CERTIFICATE OF CORRECTION

PATENT NO. : 5,875,807

DATED : March 2, 1999

INVENTOR(S) : Klaus Schulze

It is certified that error appears in the above-indentified patent and that said Letters Patent is hereby corrected as shown below:

On the Title Page, in the Title, "ESPECIALLY" should be --SPECIALLY--.

Column 1, line 1, "ESPECIALLY" should be --SPECIALLY--.

Column 1, line 34, "member" should be --membrane--.

Column 4, line 41, "through" should be --by--.

Column 4, line 53, "form" should be --from--.

Column 5, line 14, Claim 2, delete "a".

Column 6, line 5, Claim 7, "as" should be --gas--. (first occurrence)

Signed and Sealed this

Sixteenth Day of November, 1999

*Attest:*

Q. TODD DICKINSON

*Attesting Officer*

*Acting Commissioner of Patents and Trademarks*